US009945276B2

(12) United States Patent
Drees et al.

(10) Patent No.: US 9,945,276 B2
(45) **Date of Patent: *Apr. 17, 2018**

(54) EXHAUST SYSTEM FOR AN INTERNAL COMBUSTION ENGINE AND METHOD FOR OPERATING THE EXHAUST SYSTEM

(71) Applicant: Bayerische Motoren Werke Aktiengesellschaft, Munich (DE)

(72) Inventors: Rainer Drees, Munich (DE); Christian Eichmueller, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/470,028

(22) Filed: Mar. 27, 2017

(65) Prior Publication Data

US 2017/0198617 A1 Jul. 13, 2017

Related U.S. Application Data

(63) Continuation of application No. 14/874,523, filed on Oct. 5, 2015, now Pat. No. 9,605,580, which is a (Continued)

(30) Foreign Application Priority Data

May 15, 2013 (DE) ..... 10 2013 208 946

(51) Int. Cl.
*F01N 1/08* (2006.01)
*F01N 1/16* (2006.01)
(Continued)

(52) U.S. Cl.
CPC ..... *F01N 1/083* (2013.01); *F01N 1/166* (2013.01); *F01N 1/168* (2013.01); *F01N 13/02* (2013.01);
(Continued)

(58) Field of Classification Search
CPC ..... F01N 13/08; F01N 13/02; F01N 13/04; F01N 1/023; F01N 1/026; F01N 1/16;
(Continued)

(56) References Cited

U.S. PATENT DOCUMENTS 5,144,799 A 9/1992 Barth
2006/0011409 A1 1/2006 Mabuchi et al.
(Continued)

FOREIGN PATENT DOCUMENTS

DE 10 2005 032 951 A1 2/2006
DE 10 2009 032 213 A1 1/2011
(Continued)

OTHER PUBLICATIONS

International Search Report issued in PCT Application No. PCT/EP2014/058543 dated Jul. 7, 2014 with English translation (Six (6) pages).
(Continued)

*Primary Examiner* — Mary A Davis
*Assistant Examiner* — Kelsey Stanek
(74) *Attorney, Agent, or Firm* — Crowell & Moring LLP

(57) ABSTRACT

An exhaust system is provided for an internal combustion engine having at least a first and a second cylinder, wherein the first cylinder is assigned a first exhaust gas pipe and the second cylinder is assigned a second exhaust gas pipe. The first exhaust gas pipe is assigned a first muffler, and the second exhaust gas pipe is assigned a second muffler. A first damping pipe branches off from the first exhaust gas pipe upstream of a first shut-off element. The damping pipe firstly opens into a first reflection chamber and is subsequently led through the first muffler and opens into the second exhaust gas manifold downstream of a second shut-off element. A second damping pipe branches off from the second exhaust gas pipe upstream of a second shut-off element. The second
(Continued)

damping pipe firstly opens into a second reflection chamber and is subsequently led through the second muffler and opens into the first exhaust gas pipe downstream of the first shut-off element.

11 Claims, 2 Drawing Sheets

Related U.S. Application Data continuation of application No. PCT/EP2014/058543, filed on Apr. 28, 2014.

(51) Int. Cl.
*F01N 13/02* (2010.01)
*F01N 13/04* (2010.01)

(52) U.S. Cl.
CPC ..... *F01N 13/04* (2013.01); *F01N 2240/36* (2013.01); *F01N 2470/02* (2013.01)

(58) Field of Classification Search
CPC ..... F01N 1/166; F01N 1/168; F01N 2470/02; F01N 2470/36; F01N 2240/36
USPC ..... 60/273, 324, 274, 312
See application file for complete search history.

(56) References Cited

U.S. PATENT DOCUMENTS

| | | | |
|---|---|---|---|
| 2010/0071992 | A1 | 3/2010 | Feng |
| 2011/0000186 | A1 | 1/2011 | Laube et al. |
| 2011/0000201 | A1 | 1/2011 | Laube et al. |
| 2013/0008737 | A1 | 1/2013 | Mueller et al. |

FOREIGN PATENT DOCUMENTS

| | | | |
|---|---|---|---|
| DE | 10 2009 032 214 | A1 | 1/2011 |
| DE | 10 2009 032 215 | A1 | 1/2011 |
| DE | 10 2010 008 215 | A1 | 8/2011 |
| DE | 10 2011 051 690 | A1 | 1/2013 |
| EP | 2 049 777 | | 4/2009 |
| EP | 2 196 640 | A2 | 6/2010 |
| EP | 2 287 452 | A1 | 2/2011 |
| WO | WO 2008/017112 | A1 | 2/2008 |
| WO | WO 2011/100083 | A2 | 8/2011 |

OTHER PUBLICATIONS

German-language Search Report issued in counterpart German Application No. 10 2013 208 946.5 dated Jan. 8, 2014 with partial English translation (Ten (10) pages).
English Translation of Chinese Office Action dated Feb. 4, 2017 (seven (7) pages).
Chinese-language Office Action issued in counterpart Chinese Application No. 201480022080.9 dated Aug. 10, 2017 with English translation (Five (5) pages).

EXHAUST SYSTEM FOR AN INTERNAL COMBUSTION ENGINE AND METHOD FOR OPERATING THE EXHAUST SYSTEM

CROSS REFERENCE TO RELATED APPLICATIONS

This application is a continuation of U.S. patent application Ser. No. 14/874,523, filed in the U.S. Patent and Trademark Office on Oct. 5, 2015, which is a continuation of PCT International Application No. PCT/EP2014/058543, filed Apr. 28, 2014, which claims priority under 35 U.S.C. § 119 from German Patent Application No. 10 2013 208 946.5, filed May 15, 2013, the entire disclosures of which are herein expressly incorporated by reference.

BACKGROUND AND SUMMARY OF THE INVENTION

The invention relates to an exhaust system for an internal-combustion engine as well as to a method of operating the exhaust system.

From German Published Patent Application DE 10 2009 032 213 A1, an exhaust system of an internal-combustion engine is known, for example, which has a first exhaust gas system assigned to a first cylinder group of the internal-combustion engine and has a second exhaust gas system assigned to a second cylinder group of the internal-combustion engine. Each exhaust gas system has one emission control device respectively, as well as a first muffler arranged behind the respective emission control device, a second muffler arranged behind the respective first muffler, and an exhaust gas tailpipe arranged behind the respective second muffler.

It is a disadvantage of this known state of the art that the damping resonator of the muffler cannot be variably adjusted with respect to sound.

Furthermore, mufflers for exhaust systems are generally known from the state of the art, which muffles operate according to the absorption and/or reflection principle. The development of such a muffler, as a rule, involves finding the best-possible compromise between the muzzle noise (loudness after the exhaust system tailpipe), the exhaust backpressure and the required muffler volume. For bypassing such a compromise solution, mufflers are frequently designed with one or more movable closing elements or shut-off devices, such as an exhaust flap, in order to provide different flow paths in the exhaust pipe of the muffler system. In the case of muffler systems for internal-combustion engines, often two, three or even four exhaust system tailpipes are provided. In muffler constructions known from prior art, the arrangement of the closing elements has the disadvantageous effect that, depending on the position of the closing element, exhaust gas will no longer flow through all exhaust system tailpipes or even tailpipe branching elements.

This state of the art has the following disadvantages:

1) Irritation on the part of the customer because exhaust gas does not flow out of all exhaust system tailpipes (at low outside temperatures recognizable by water vapor and by the different degree of dirt at the visible tailpipes);
2) High exhaust gas backpressure as a result of a bottleneck in the exhaust system tailpipe;
3) Audible flow-generated noise as a result of the bottleneck in the exhaust system tailpipe;

4) Thermal stress between the cold and hot exhaust system tailpipe carries the risk of crack formation;
5) Costly guidance of the damping pipes in the case of the muffler system;
6) Heavy weight of muffler system;
7) High manufacturing costs of muffler system; and
8) Normally, flaps are to be separately switched only to a limited extent and in a time-staggered manner. This results in a clear rise of the exhaust gas backpressure in an exhaust gas system.

It is an object of the present invention to avoid the above-mentioned disadvantages and simultaneously introduce variability into the acoustic damping characteristics of the muffler system.

This and other objects are achieved by providing an exhaust system for an internal-combustion engine, having at least a first and a second cylinder, a first exhaust pipe being assigned to the first cylinder and a second exhaust pipe being assigned to the second cylinder, and a first muffler being assigned to the first exhaust pipe and a second muffler being assigned to the second exhaust pipe. A first damping pipe branches off the first exhaust pipe upstream of a first shut-off element, which first damping pipe first leads into a first reflection chamber and subsequently extends through the first muffler and leads into the second exhaust pipe downstream of a second shut-off element. A second damping pipe branches off the second exhaust pipe upstream of a second shut-off element, which second damping pipe first leads into a second reflection chamber and subsequently extends through the second muffler and leads into the first exhaust pipe downstream of the first shut-off element.

As a result of the further development of the exhaust system according to the invention, all above-mentioned problems will be avoided. The exhaust system has a construction that is advantageous with respect to the exhaust gas backpressure. By means of the construction according to the invention, one or both shut-off elements can also be closed simultaneously without significantly increasing the exhaust gas backpressure. In contrast to conventional exhaust systems, when the shut-off elements, such as the exhaust gas flaps, are open, a minimal or hardly measurable throttling (rise of the exhaust gas backpressure) will take place, because the entire exhaust pipe volume and damping pipe volume is utilized to the end of the exhaust system. By way of a slightly altered construction, the shut-off elements can also be switched in a time-staggered manner, in order to improve a subjective hearing impression during the switching phases. As a result of the staggered switching-over of the two shut-off elements, noticeable acoustic level jumps can be advantageously reduced.

With respect to performance and dynamics (response behavior of the internal-combustion engine), the very low exhaust gas backpressure of the exhaust system caused by the further development according to the invention has a very positive effect. For slight acoustic adaptations, the volumes of the first muffler and of the second muffler can also be changed later. In addition, one or more possibly required resonators can be integrated in the exhaust system without large expenditures and while retaining symmetry. As a result of the symmetrical construction of the exhaust system, the latter and furthermore the muffler itself can have a very advantageous structure.

Many components of the exhaust system according to the invention can be produced or used in a cost-effective manner as identical parts.

The muffler housing may, for example, be implemented as a cost-effective wound muffler or in a shell construction.

When it is implemented as a wound muffler, the two lateral parts can be constructed as identical parts. In the shell construction, the top shell and the bottom shell can be designed of identical parts respectively.

The exhaust pipes can also be produced and installed as identical parts.

The Y-branching elements from the exhaust pipes to the damping pipes may, for example, be implemented as an internal high-pressure preform (IHU). The damping pipes with perforations, which extend through the mufflers, can also be implemented as identical parts. This also applies to the damping pipe from the Y-pipe piece into the reflection chamber.

Because of the identical parts for the exhaust system, tools can also be saved for the assembly. Depending on how a manufacturer's or supplier's production is structured, an identical assembly system can be used for the pre-assembly of the Y-branching elements and of the shut-off elements for both sides of the exhaust system.

All above-mentioned points result in a significant reduction of the tool and production costs for the exhaust system according to the invention.

In addition, as a result of the large proportion of identical parts and the reduction of component variants, a possibly desired light-weight construction can clearly be implemented more easily.

In a further development, a third reflection chamber is assigned to the first exhaust pipe downstream of the first shut-off element, and/or a fourth reflection chamber is assigned to the second exhaust pipe downstream of the second shut-off element.

In a still further development, the first exhaust pipe is connected by way of perforations in an exhaust-gas-carrying manner with the third reflection chamber, and/or the second exhaust pipe is connected by way of perforations in an exhaust-gas-carrying manner with the fourth reflection chamber.

A further fine-tuning of the exhaust system sound can be achieved by way of a further development in that the first and the third reflection chambers and/or the second and the fourth reflection chambers are connected with one another in an exhaust-gas-carrying manner. In order to reduce manufacturing costs even more, in a further development the first and second mufflers are arranged in a common housing. Moreover, the first and second reflector chambers may he arranged in the housing, and the third and fourth reflection chambers may be arranged in the housing.

Minimal damping is achieved by means of the method of operating an exhaust system for an internal-combustion engine wherein the first and second shut-off elements are opened.

Medium damping is achieved by means of the method of operating an exhaust system for an internal-combustion engine wherein the first shut-off element is opened and the second shut-off element is closed.

Maximal damping is achieved by means of the method of operating an exhaust system for an internal-combustion engine wherein the first and second shut-off elements are closed.

In the following, an exhaust system according to the invention and three methods of operating the exhaust system according to the invention will be explained.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
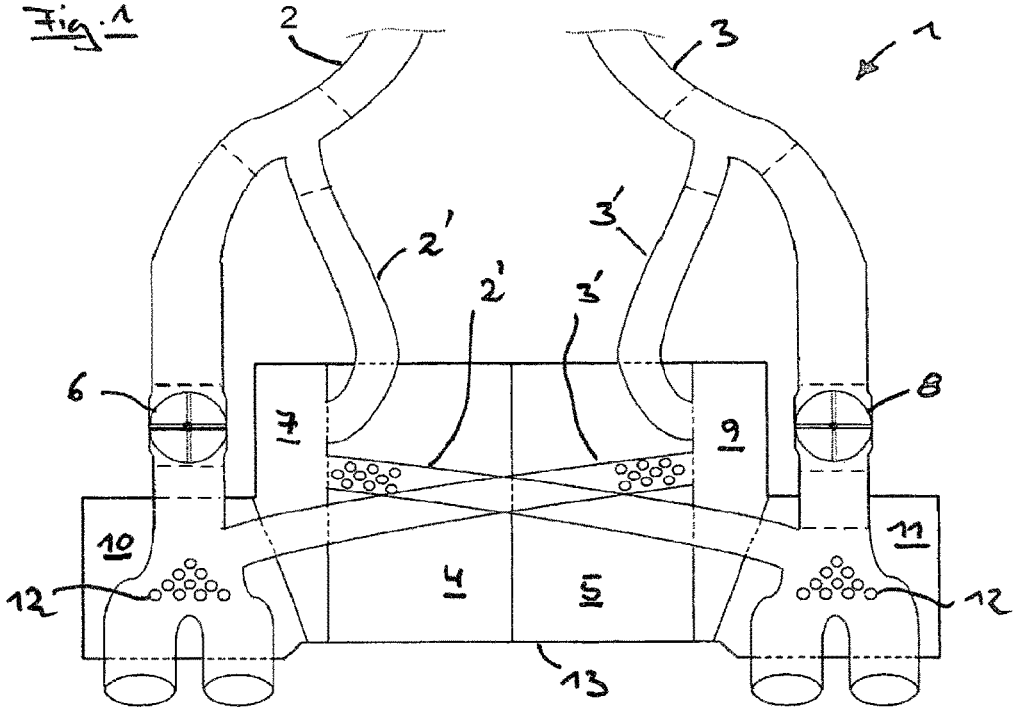
FIG. 1 is a schematic view of an exhaust system according to an embodiment of the invention.

FIG. 1 illustrates an end section of an exhaust system 1 for an internal-combustion engine (not shown) having at least a first and a second cylinder (also not shown). The first and the second cylinder are also representative of cylinder groups of the internal-combustion engine. For example, in the case of a six-cylinder internal-combustion engine, cylinders 1 to 3 represent cylinder group 1, and cylinders 4 to 6 represent cylinder group 2. A first exhaust pipe 2 is assigned to the first cylinder, and a second exhaust pipe 3 is assigned to the second cylinder. Furthermore, a first muffler 4 is assigned to the first exhaust pipe 2, and a second muffler 5 is assigned to the second exhaust pipe 3.

Figure 2:
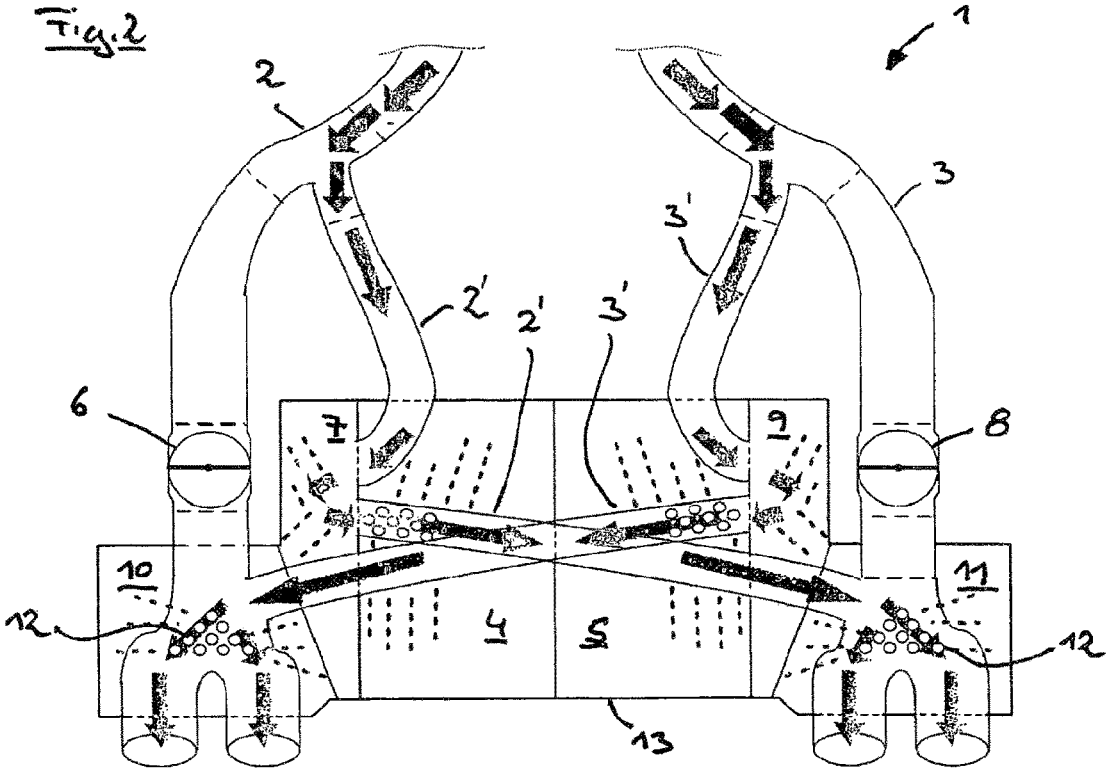
FIG. 2 is a view of the exhaust system according to the embodiment of the invention with two closed shut-off elements.
Figure 3:
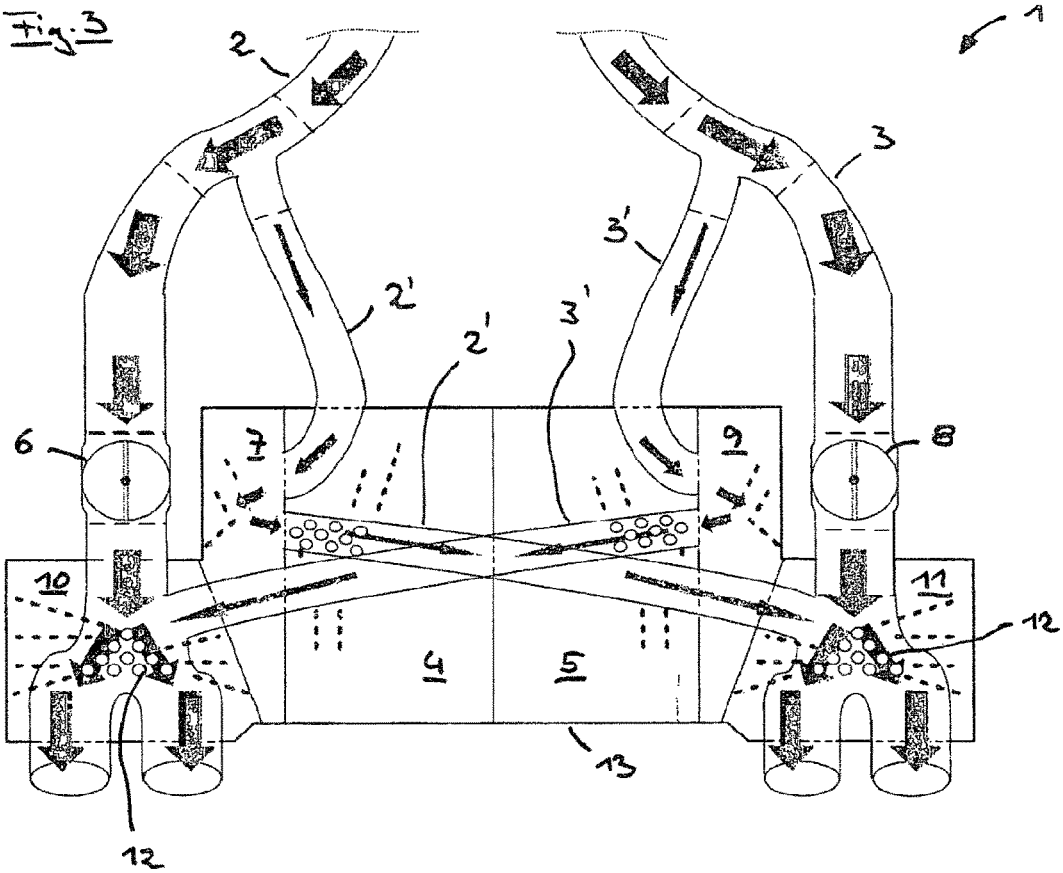
FIG. 3 is a view of the exhaust system according to the embodiment of the invention with two opened shut-off elements.
Figure 4:
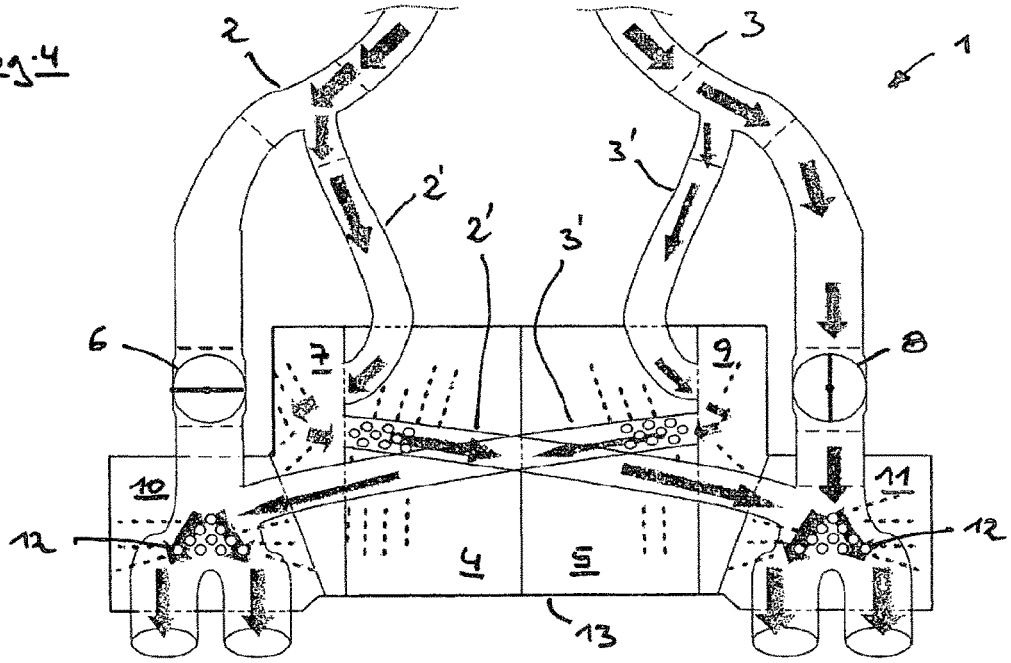
FIG. 4 is a view of the exhaust system according to the embodiment of the invention with one closed and on opened shut-off element.

According to an embodiment of the invention, a first damping pipe 2' branches off the first exhaust pipe 2 upstream of a first shut-off element 6. This first damping pipe 2' first leads out into a first reflection chamber 7 and subsequently extends through the first muffler 4 and again leads into the second exhaust pipe 3 downstream of a second shut-off element 8. Furthermore, a second damping pipe 3' branches off the second exhaust pipe 3 upstream of a second shut-off element 8, which damping pipe 3' first leads into a second reflection chamber 9 and subsequently extends through the second muffler 5 and leads into the first exhaust pipe 2 downstream of the first shut-off element 6. Flow directions of the exhaust gases, which are indicated by arrows, are illustrated in FIGS. 2 to 4.

As known from the state of the art, the first damping pipe 2' and the second damping pipe 3' have perforations in the volume of the first muffler 4 and in the volume of the second muffler 5, for the output of sound emissions into the mufflers 4, 5 for the frequency-selective damping of the sound pressure level. In FIGS. 2 to 4, the damping effect is symbolically illustrated by broken lines in the area of the perforations.

In the present embodiment, the first and the second shut-off elements 6, 8 are exhaust flaps; in other embodiments, they may, for example, be rolls.

Furthermore, a third reflection chamber 10 is assigned to the first exhaust pipe 2 downstream of the first shut-off element 6, and a fourth reflection chamber 11 is assigned to the second exhaust pipe 3 downstream of the second shut-off element 8. In another embodiment, one reflection chamber 10, 11 may be absent.

The first exhaust pipe 2 is preferably connected by way of perforations 12 in an exhaust-gas-carrying manner with the third reflection chamber 10 and/or the second exhaust pipe 3 is connected by way of perforations 12 in an exhaust-gas-carrying manner with the fourth reflection chamber 11. In a further embodiment, the first and the third reflection chamber 7, 10 and/or the second and the fourth reflection chamber 9, 11 may be mutually connected in an exhaust-gas-carrying manner, for example, by way of an additional perforation. These measures permit a further acoustic optimization.

Particularly preferably, the first and the second muffler 4, 5 are arranged in a common housing 13, whereby manufacturing costs can be saved.

In another particularly preferred embodiment, the first and the second reflection chamber 7, 9 are also arranged in the housing 13. The most costs are saved when also the third and the fourth reflection chamber 10, 11 are arranged in the housing 13.

In another further embodiment, the first and the second reflection chambers 7, 9 may also be designed as resonator chambers.

In a further embodiment, the third and the fourth reflection chambers 10. 11 may also be designed as absorption chambers. The respective further development of a reflection chamber, of a resonator chamber or absorption chamber will not be explained in detail in the following, since they are sufficiently defined in conventional textbooks.

As a result of the symmetrical construction of the entire exhaust system 1, particularly the manufacturing costs can be reduced, because the identical-part principle can be applied to a large extent. Thus, for example, the Y-branching pipes (transition area from the exhaust pipe to the damping pipe), the damping pipes 2', 3', the shut-off elements 6, 8, the tailpipe branchings, the reflection chambers 7, 9, 10, 11, the mufflers 4, 5 and the exhaust pipes 2, 3 may be designed as identical parts. In a particularly advantageous fashion, the mufflers 4, 5, and the reflection chambers 7, 9, 19, 11 can be cost-effectively accommodated in a single common housing 13.

Assembly tools can also be saved for the production as a result of the identical parts for the exhaust system 1. This leads to a clear reduction of tool costs.

FIGS. 2 to 4, in which the same reference symbols as in FIG. 1 apply to identical components, show the same exhaust system as in FIG. 1 again, but for three different operating conditions. As mentioned above, exhaust gas flow directions are schematically illustrated by arrows.

FIG. 2 illustrates the exhaust system 1 with a setting for a first operating method, in which the first and the second shut-off elements 6, 8 are closed. By means of this setting, maximal muffling is achieved for the exhaust system 1.

FIG. 3 illustrates the exhaust system 1 according to the invention with a setting for a second operating method, in which the first and the second shut-off elements are open. By means of this setting, minimal muffling is achieved for the exhaust system 1.

FIG. 4 illustrates the exhaust system 1 according to the invention with a setting for a third operating method, in which the first shut-off element 6 is closed and the second shut-off element 8 is open. By means of this setting, medium muffling is achieved for the exhaust system 1.

The exhaust system 1 according to the invention has a very advantageous construction with respect to the exhaust gas backpressure. By means of the construction according to the invention, one or both shut-off elements 6, 8 may also be closed simultaneously with any significant rise of the exhaust gas backpressure. In contrast to conventional exhaust systems, a minimal or hardly measurable throttling (raising of the exhaust gas backpressure) takes place when shut-off elements 6, 8, such as exhaust gas flaps, are open, because the entire exhaust gas is utilized—from the damping pipe volume to the end of the exhaust system 1. As a result of a slightly changed construction, the shut-off elements 6, 8 can also be switched in a time-staggered manner, in order to improve a subjective hearing impression during the switching phase. By means of the staggered switching-over of the two shut-off elements 6, 8, level jumps that are too conspicuous can be advantageously reduced.

The very low exhaust gas backpressure of the exhaust system 1 caused by the further development according to the invention has a very positive effect on the performance and dynamics (response behavior of the internal-combustion engine). For slight acoustic adaptations, the volumes of the first muffler 4 and of the second muffler 5 may also be changed later. In addition, one or more possibly required resonator chambers 10, 11, also constructed as reflection chambers, can also be integrated in a simple manner without large expenditures into the exhaust system while symmetry is maintained.

Because of the arrangement of the first and the second adjusting elements 6, 8 in the first and in the second exhaust pipes 2, 3 in the flow direction of the exhaust gas in front of the exhaust gas tailpipe, a switching operation can practically not be heard by persons on the outside.

LIST OF REFERENCE NUMBERS

1. Exhaust system
2. First exhaust pipe
2' First damping pipe
3. Second exhaust pipe
3' Second damping pipe
4. First muffler
5. Second muffler
6. First shut-off element
7. First reflection chamber (resonator chamber)
8. Second shut-off element
9. Second reflection chamber (resonator chamber)
10. Third reflection chamber (absorption chamber
11. Fourth reflection chamber (absorption chamber)
12. Perforations
13. Housing The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust system for an internal combustion engine having at least a first and a second cylinder, the exhaust system comprising:

a first exhaust pipe assigned to the first cylinder;

a second exhaust pipe assigned to the second cylinder;

a first muffler assigned to the first exhaust pipe;

a second muffler assigned to the second exhaust pipe;

a first damping pipe branching off of the first exhaust pipe upstream of a first shut-off element in the first exhaust pipe;

a second damping pipe branching off of the second exhaust pipe upstream of a second shut-off element in the second exhaust pipe, wherein the first damping pipe leads first into a first reflection chamber and subsequently extends through the first muffler and leads into the second exhaust pipe downstream of the second shut-off element in a portion of the second exhaust pipe located in a fourth reflection chamber, the second damping pipe leads first into a second reflection chamber and subsequently extends through the second muffler and leads into the first exhaust pipe downstream of the first shut-off element in a portion of the first exhaust pipe located in a third reflection chamber, the first exhaust pipe is connected in an exhaust-gas-carrying manner, by way of perforations in the second exhaust pipe, with the third reflection chamber, and the second exhaust pipe is connected in an exhaust-gas-carrying manner by way of perforations in the first exhaust pipe, with the fourth reflection chamber.

2. The exhaust system according to claim 1, wherein at least one of the first and the third reflection chambers are connected with one another in an exhaust-gas-carrying manner and the second and the fourth reflection chambers are connected with one another in an exhaust-gas-carrying manner.

3. The exhaust system according to claim 1, wherein at least one of the first and the third reflection chambers are connected with one another in an exhaust-gas-carrying manner and the second and the fourth reflection chambers are connected with one another in an exhaust-gas-carrying manner.

4. The exhaust system according to claim 1, further comprising a common housing in which the first and the second mufflers are arranged.

5. The exhaust system according to claim 4, wherein the first and the second reflection chambers are arranged in the common housing.

6. The exhaust system according to claim 5, wherein the third and the fourth reflection chambers are arranged in the common housing.

7. The exhaust system according to claim 4, wherein the third and the fourth reflection chambers are arranged in the common housing.

8. A method of operating an exhaust system for an internal combustion engine having at least a first and a second cylinder, the method comprising the acts of:

providing a first exhaust pipe assigned to the first cylinder;

providing a second exhaust pipe assigned to the second cylinder;

providing a first muffler assigned to the first exhaust pipe;

providing a second muffler assigned to the second exhaust pipe;

providing a first damping pipe branching off of the first exhaust pipe upstream of a first shut-off element in the first exhaust pipe;

providing a second damping pipe branching off of the second exhaust pipe upstream of a second shut-off element in the second exhaust pipe, wherein the first damping pipe leads first into a first reflection chamber and subsequently extends through the first muffler and leads into the second exhaust pipe downstream of the second shut-off element in a portion of the second exhaust pipe located in a fourth reflection chamber, the second damping pipe first leads into a second reflection chamber and subsequently extends through the second muffler and leads into the first exhaust pipe downstream of the first shut-off element in a portion of the first exhaust pipe located in a third reflection chamber, the first exhaust pipe is connected in an exhaust-gas-carrying manner, by way of perforations in the second exhaust pipe, with the third reflection chamber, and the second exhaust pipe is connected in an exhaust-gas-carrying manner by way of perforations in the first exhaust pipe, with the fourth reflection chamber; and opening the first and the second shut-off elements for minimal muffling.

9. The method according to claim 8, further comprising the act of:

opening the first shut-off element and closing the second shut-off element for medium muffling.

10. The method according to claim 9, further comprising the act of:

closing the first and the second shut-off elements for maximum muffling.

11. The method according to claim 8, further comprising the act of:

closing the first and the second shut-off elements for maximum muffling.

* * * * *